United States Patent [19]

Lee

[11] Patent Number: 4,901,623

[45] Date of Patent: Feb. 20, 1990

[54] COMPENSATING DEVICE FOR GAS ACTUATED FIREARMS

[75] Inventor: Joseph L. Lee, Woodbridge, Conn.

[73] Assignee: O.F. Mossberg & Sons, Inc., North Haven, Conn.

[21] Appl. No.: 667,105

[22] Filed: Nov. 1, 1984

[51] Int. Cl.[4] ..... F41D 5/08

[52] U.S. Cl. ..... 89/193; 89/191.02

[58] Field of Search ..... 89/191.01, 192, 193, 89/191.02, 1.703; 138/31

[56] References Cited

U.S. PATENT DOCUMENTS

| | | | |
|---|---|---|---|
| 933,098 | 9/1909 | McClean | 89/191.01 |
| 1,804,388 | 5/1931 | Conlon | 89/193 |
| 2,909,101 | 10/1959 | Hillberg | 89/191.02 |
| 3,200,710 | 8/1965 | Kelly et al. | 89/191.02 |
| 3,848,511 | 11/1974 | Zanoni | 89/191.02 |
| 3,968,727 | 7/1976 | Hyytinen | 89/191.02 |
| 4,046,167 | 9/1977 | Papp et al. | 138/31 |
| 4,102,242 | 7/1978 | Liedke | 89/191.01 |
| 4,389,920 | 6/1983 | DuFour | 89/191.02 |

*Primary Examiner*—Deborah L. Kyle
*Assistant Examiner*—Stephen Johnson
*Attorney, Agent, or Firm*—McCormick, Paulding & Huber

[57] ABSTRACT

An autoloading shotgun having a receiver, a barrel projecting from the receiver, a magazine tube supported on the receiver in parallel relation to the barrel, a generally cylindrical gas cylinder mounted in fixed position relative to the barrel and coaxially surrounding relation to an associated portion of the magazine tube, and in an annular piston received within the gas chamber and coaxially surrounding an associated portion of the magazine tube and supported for movement along the magazine tube and toward and away from the receiver. The gas cylinder, magazine tube and piston cooperate to define an annular a gas chamber in communication with the shotgun bore. An obturation ring coaxially surrounding the magazine tube forward of the gas cylinder is biased into engagement with an annular seating surface on the forward end of the gas cylinder to provide a closure for gas ports communicating with the gas chamber and opening through the seating surface. The obturation ring moves along the magazine tube and away from the gas cylinder to vent gases of explosion from the gas cylinder when the pressure within the gas cylinder exceeds a predetermined magnitude.

11 Claims, 2 Drawing Sheets

COMPENSATING DEVICE FOR GAS ACTUATED FIREARMS

This invention relates in general to gas actuated autoloading firearms, and deals more particularly with an improved gas compensator for a semi-automatic shotgun which includes an elongated magazine tube supported in parallel relation to the barrel of the shotgun and a gas cylinder supported in coaxial surrounding relation with an associated portion of the magazine tube and which cooperates with the magazine tube to define an annular gas chamber. Such a firearm must be capable of firing ammunition which varies widely as to the power of its propellent charge or load. The gas system for such a firearm must be capable of operation in response to pressure developed by the gases of explosion in firing a low power charge. However, the parts of the gas operating system are likely to be subjected to severe shock when a heavy charge, such as a magnum charge, is fired.

Heretofore, various devices have been provided to regulate pressure developed by the gases of explosion entering the gas operating system or to otherwise compensate for very high pressures developed when a high powered charge is fired, to prevent undue stress upon and possible damage to the gas actuated operating mechanism. However, such devices are generally complex and add substantially to the cost of producing a firearm.

Accordingly, it is the general aim of the present invention to provide an improved compensating device of simple durable construction and which may be added to an existing firearm without substantial modification of the firearm.

BACKGROUND OF THE INVENTION

In accordance with the present invention, an improved pressure control means is provided for limiting the pressure developed in the gas chamber of a firearm which has a receiver, a barrel supported on and projecting forwardly of the receiver, a bolt supported within the receiver for movement between battery and retired positions, a magazine tube supported on and projecting forwardly of the receiver in axially parallel relation to the barrel, a generally cylindrical gas cylinder mounted in fixed position relative to the barrel and coaxially surrounding an associated portion of the magazine tube in axially spaced relation to the receiver, and an annular piston received within the gas cylinder and coaxially surrounding an associated portion of the magazine tube. The piston is supported on the magazine tube for movement therealong and generally toward and away from the receiver. Action bar means is provided for moving the bolt in response to movement of the piston relative to the cylinder. The cylinder cooperates with the magazine tube and the piston to define an annular gas chamber. The firearm further includes means defining a gas port which communicates with the gas chamber forward of the piston and with the bore for venting gases of explosion from the bore into the gas chamber. In accordance with the invention, the improved pressure control means comprises a generally radially disposed and forwardly facing first annular surface on the gas cylinder, a gas port defined by the gas cylinder and communicating with the chamber and opening through the first annular surface, and an obturation ring supported in coaxial surrounding relation to an associated portion of the magazine tube forward of the gas cylinder. The obturation ring has a generally radially disposed and rearwardly facing second annular surface for sealing engagement with the first annular surface. A means is provided for biasing the obturation ring toward the gas cylinder to maintain the second annular surface in sealing engagement with the first annular surface when the pressure within the gas cylinder is below a predetermined magnitude. The obturation ring is movable away from the gas chamber in response to pressure developed within the chamber in excess of the predetermined magnitude to vent the gases of explosion from the chamber to the atmosphere.

DETAILED DESCRIPTION OF PREFERRED EMBODIMENT

Figure 1:
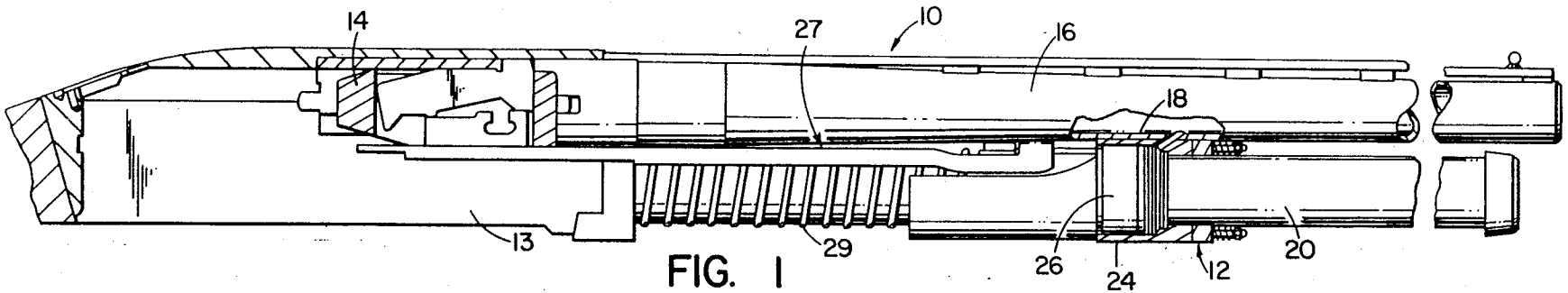
FIG. 1 is fragmentary longitudinal sectional view through a firearm embodying the present invention.

Turning now to the drawing, a gas actuated firearm or autoloading shotgun, indicated generally by the numeral 10, includes a compensating device embodying the invention and designated generally by the reference numeral 12. Various conventional parts of the shotgun 10, not essential to an understanding of the invention, such as the hammer, trigger, extractor, ejector and elevator mechanisms, are omitted from the drawing, for clarity of illustration. The illustrated shotgun 10 is a MOSSBERG Model 5500 Autoloading Shotgun, manufactured and marketed by O. F. Mossberg & Sons, Inc., North Haven, Conn. 06473, assignee of the present invention, and generally comprises a receiver 13, and a breech bolt 14 supported within the receiver for movement therein between battery and retired positions, and a gas actuated operating mechanism for unlocking the breech bolt and moving it from its battery position to its retired position. In FIG. 1 the breech bolt is shown locked in its battery position, in a manner well known in the art.

A barrel 16 projects forwardly from the receiver and defines a bore 18. The shotgun 10 further includes a magazine tube 20, which projects forwardly from the receiver below and in generally axially parallel relation to the barrel 16. The magazine tube is closed at its forward end by a conventional releasably secured magazine cap, communicates at its rear end with the receiver 13, and contains a magazine spring 22 for urging successive shotgun shells from the magazine tube to loading position within the receiver in a manner well known in the shotgun art.

The gas actuated operating mechanism for operating the breech bolt 14 includes an annular gas cylinder 24, an annular piston 26, and an action bar assembly, indicated generally at 27, which connects the piston 26 to the breech block 14. The gas cylinder is mounted in fixed position relative to the barrel 16 and coaxially surrounds an associated portion of the magazine tube 20 in axially spaced relation to the receiver 13. The annular piston 26 is received within the gas cylinder 24, coaxially surrounds the magazine tube 20, and is biased toward the gas cylinder by a spring 29. The piston is supported on the magazine tube for sliding movement therealong generally toward and away from the receiver 13. The gas cylinder 24 cooperates with the piston 26 and with an associated portion of the magazine tube 20 to define an annular gas chamber 28, best shown in FIG. 2. A gas port 30 defined by the barrel 16 and the gas cylinder 24 provides communication between the gas chamber 28 and the bore 18 to allow gases of explosion to enter the gas chamber 28 from the bore 18 when the shotgun 10 is discharged, as will be hereinafter more fully discussed.

Considering now the improved compensating device 12 and referring particularly to FIGS. 2–5, the compensating device essentially comprises an annular member or obturation ring 32 which coaxially encircles an associated portion of the magazine tube 20 forward of the gas cylinder 24. The obturation ring has a generally radially disposed and rearwardly facing annular surface 34 for engaging and seating upon a generally radially disposed and forwardly facing annular seating surface 36 defined by the forward end of the gas cylinder 24.

Figure 3:
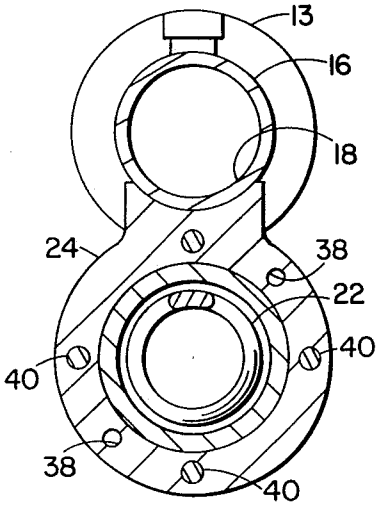
FIG. 3 is a sectional view taken along the line 3—3 of FIG. 2.

At least one vent passageway 38, formed in the gas cylinder 24, communicates with the gas chamber 28 forward of the piston 26 and opens through the seating surface 36, but preferably, and as shown, a pair of vent passageways 38, 38 are formed in the gas cylinder in diametrically opposite sides of the cylinder wall and open through the seating surface 36 at diametrically opposite locations, as best shown in FIG. 3.

Figure 2:
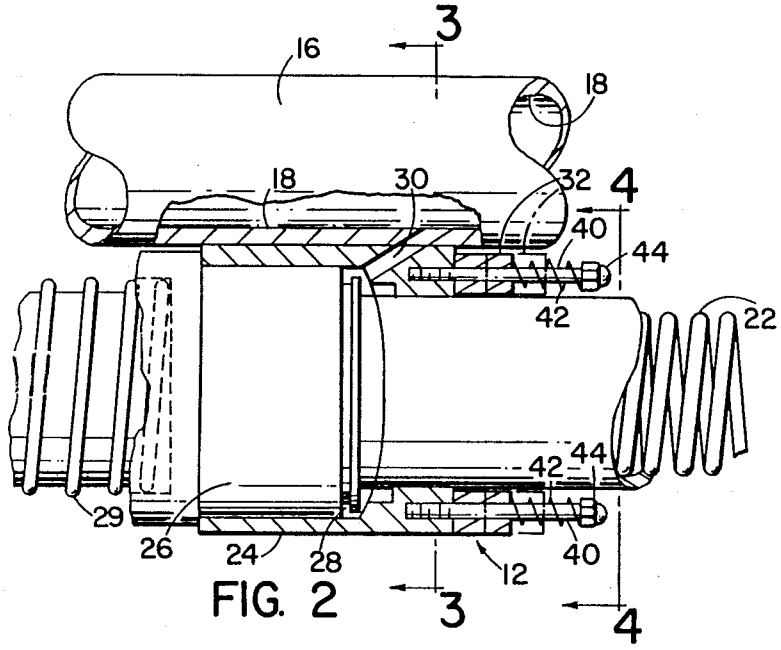
FIG. 2 is a somewhat enlarged fragmentary side elevational view of a portion of the firearm shown in FIG. 1, the gas cylinder, obturator ring and a portion of the barrel being shown in longitudinal section.

The obturation ring 32 is preferably retained for limited movement generally toward and away from the gas cylinder 24 by a plurality of equiangularly spaced guide rods or studs 40, 40 which project forwardly from the gas cylinder in axially parallel relation to the magazine tube and extend through associated apertures in the obturation ring 32. Preferably, and as shown, a guide rod 40, 40 comprises studs threaded into seating engagement with the gas cylinder 24, as best shown in FIG. 2. Each guide rod 40 is threaded at its forward or free end and receives an associated biasing spring 42 thereon. Each spring acts between the obturation ring 32 and an associated cap nut 44 threaded on the free end of the guide rod. The springs are chosen to provide sufficient biasing force to maintain the obturation ring 32 in seated position upon the seating surface 36 under normal operating conditions. Under such conditions sufficient pressure will be developed within the gas chamber to operate the piston-action bar assembly without placing undue strain upon the mechanism. Thus, when the shotgun 10 is loaded with ammunition having a relatively light charge and discharged gases of explosion bled from the bore 18 enter the gas chamber 28 and act upon the piston 26 to impel the piston and the action bar assembly 27 in a rearward direction or in the direction of the receiver 13. Initial movement of the piston-action bar assembly relative to the breech bolt 14 unlocks the bolt. Thereafter, further rearward travel of the piston-action bar assembly causes the breech bolt to move toward its retired position in a manner well known in the art.

Figure 5:
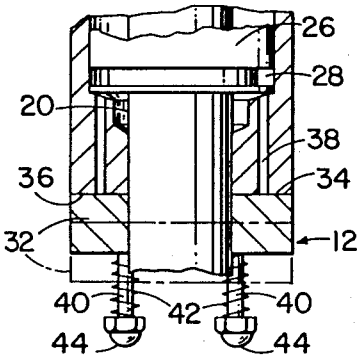
FIG. 5 is a fragmentary sectional view taken along the line 5—5 of FIG. 4.

When a shell having a high powered charge, such as a magnum shotgun shell, is fired in the shotgun 10, and the magnitude of the pressure developed within the chamber 28 exceeds the predetermined magnitude, the obturator ring 32 will be driven in a forward direction from its seated or full line position to an unseated position, such as indicated by broken line position of FIGS. 2 and 5 to expose the openings in the seating surface 36 formed by the intersection of the vent passageways 38, 38 with the seating surface to vent gases of explosion from the gas chamber 28.

The biasing force exerted upon the obturation ring 32 by the biasing springs is preferably adjusted during manufacture so that the obturation ring 32 will unseat to vent gases of explosion from the chamber 28 in response to a predetermined pressure condition within the latter chamber, and it is for this reason that seated studs 40, 40 and cap nuts 44, 44 are employed to secure the biasing springs 42, 42. The diametrically arranged relationship of the vent passageways 38, 38 results in a substantially uniform forwardly directed force being exerted on the obturation ring 32 in response to gas pressure within the gas chamber.

Figure 6:
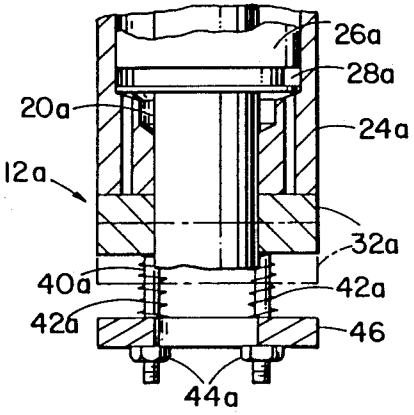
FIG. 6 is similar to FIG. 5, but shows another embodiment of the invention.
Figure 4:
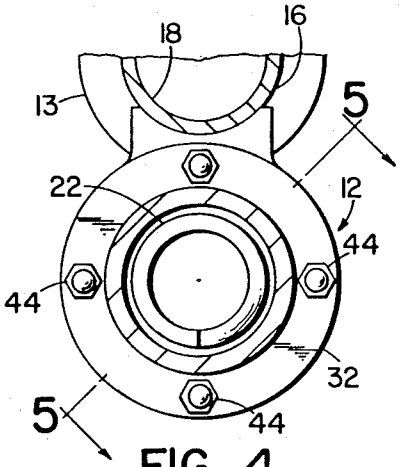
FIG. 4 is a fragmentary sectional view taken along the line 4—4 of FIG. 2.

In an instance where it may be desirable to facilitate field adjustment of the force required to unseat the obturation ring, ordinary nuts may be substituted for the cap nuts 44, 44. Such an embodiment of the invention is illustrated in FIG. 6 wherein the compensating device is indicated generally at **12*a*. The illustrated compensating device 12*a* also includes a stabalizing ring 46 which encircles the magazine tube 20*a*. The stabalizing ring 46 is received on the forward ends of the guide rods 40*a*, 40*a*, substantially as shown in FIG. 6, and serves to maintain the rods in parallel alignment with each other, so that the obturation ring 32*a* can slide freely along the guide rods. The springs 42*a*, 42*a* act between the stabalizing ring 46 and the obturation ring 32*a*. Nuts 44*a*, 44*a* are employed to secure the stabalizing ring 46 and may be adjusted relative to the guide rods 40*a*, 40*a* to vary the biasing force exerted upon the obturation ring 32*a* by the springs 42*a*, 42*a***.

I claim:

1. In a firearm having a receiver, a barrel supported on and projecting forwardly of the receiver and including a bore, a breech bolt supported within the receiver for movement therein between battery and retired positions, a magazine tube supported on and projecting forwardly of the receiver in axially parallel relation to the barrel, a generally cylindrical gas cylinder mounted in fixed position relative to the barrel and coaxially surrounding an associated portion of the magazine tube in axially spaced relation to the receiver, an annular piston received within the gas cylinder and coaxially surrounding an associated portion of the magazine tube, the piston being supported on said magazine tube for movement therealong and generally toward and away from the receiver, action bar means for moving the breech bolt in response to movement of the piston relative to the gas cylinder, the cylinder cooperating with the magazine tube and the piston to define an annular gas chamber, means defining a bleed port communicating with the bore and with the gas chamber forward of the piston for venting gases of explosion from the bore into the gas chamber, and compensating means for limiting pressure developed within the gas chamber, the improvement wherein said compensating means comprises a generally radially disposed and forwardly facing first annular seating surface on said gas cylinder, at least one gas vent port defined by said gas cylinder communicating with said gas chamber and opening through said first annular seating surface, an obturation ring supported in coaxial encircling relation to an associated portion of said magazine tube forward of said gas cylinder and having a generally radially disposed and rearwardly facing second annular seating surface for seating engagement with said first annular seating surface, and means for biasing said obturation ring toward said gas cylinder to maintain second annular seating surface in seating engagement with said first annular seating surface and in closing relation to said one gas vent port when the magnitude of pressure within said gas cylinder is lower than a predetermined magnitude, said obturation ring being movable away from said gas cylinder and out of seating engagement in response to pressure within said chamber in excess of said predetermined magnitude to vent gases of explosion from said gas chamber through said one gas port and to the atmosphere.

2. In a firearm as set forth in claim 1 the further improvement wherein said compensating means comprises a plurality of gas vent ports opening through said first annular surface at equiangularly spaced locations about the axis of said gas cylinder.

3. In a firearm as set forth in claim 1 wherein said biasing means is further characterized as spring biasing means.

4. In a firearm as set forth in claim 3 the further improvement wherein said spring biasing means comprises a plurality of springs.

5. In a firearm having a receiver, a barrel supported on and projecting forwardly of the receiver and including a bore, a breech bolt supported within the receiver for movement therein between battery and retired positions, a magazine tube supported on and projecting forwardly of the receiver in axially parallel relation to the barrel, a generally cylindrical gas cylinder mounted in fixed position relative to the barrel and coaxially surrounding an associated portion of the magazine tube in axially spaced relation to the receiver, an annular piston received within said gas cylinder and coaxially surrounding an associated portion of the magazine tube, said piston being supported on the magazine tube for movement therealong and generally toward and away from the receiver, an action bar connected to the breech bolt and to the piston for moving the breech bolt in response to movement of the piston relative to the gas cylinder, the gas cylinder cooperating with the magazine tube and the piston to define an annular gas chamber coaxially surrounding an associated portion of the magazine tube, means defining a bleed port communicating with the bore and with the gas chamber forward of the piston for venting gases of explosion from the bore into the gas chamber, and compensating means for limiting pressure developed within the gas chamber, the improvement wherein said compensating means comprises a generally radially disposed and forwardly facing first annular seating surface on said gas cylinder, a plurality of gas vent ports defined by said gas cylinder in communication with said gas chamber and opening through said first annular seating surface at equiangularly spaced locations about the axis of said magazine tube, an obturation ring received on and coaxially surrounding an associated portion of said magazine tube forward of said gas cylinder and having a generally radially disposed and rearwardly facing second annular seating surface for seating engagement with said first annular seating surface to form a closure for said gas vent ports opening through said first annular seating surface, a plurality of studs threadably engaged with said gas cylinder and projecting forwardly from said first annular seating surface in equiangularly spaced relation about the axis of said magazine tube, said studs extending through said obturation ring and supporting said ring for sliding movement therealong generally toward and away from said first seating surface, a plurality of nuts equal in number to said guide rods, each of said nuts being received on the free end of an associated one of said guide rods, and a plurality of compression springs equal in number to said guide rods, each of said springs being received upon an associated one of said guide rods and acting between an associated nut and said obturation ring, said springs biasing said obturation ring toward said gas cylinder and maintaining said second annular seating surface in engagement with said first annular seating surface and in closing relation with said gas vent ports opening through said first annular seating surface when the magnitude of pressure within said gas cylinder is lower than a predetermined magnitude, said obturation ring being movable away from said gas cylinder and out of seating engagement in response to pressure within said chamber in excess of said predetermined magnitude to vent gases of explosion from said gas chamber through said gas vent ports and to the atmosphere.

6. In a firearm having a receiver, a barrel supported on and projecting forwardly of the receiver and including a bore, a breech bolt supported within the receiver for movement therein between battery and retired positions, a magazine tube supported on and projecting forwardly of the receiver in axially parallel relation to the barrel, a generally cylindrical gas cylinder mounted in fixed position relative to the barrel and coaxially surrounding an associated portion of the magazine tube in axially spaced relation to the receiver, an annular piston received within the gas cylinder and coaxially surrounding an associated portion of the magazine tube, the piston being supported on said magazine tube for movement therealong and generally toward and away from the receiver, action bar means for moving the breech bolt in response to movement of the piston relative to the gas cylinder, the gas cylinder cooperating with the magazine tube and the piston to define an annular gas chamber, means defining a bleed port communicating with the bore and with the gas chamber forward of the piston for venting gases of explosion from the bore into the gas chamber, and compensating means for limiting pressure developed by gases of explosion within the gas chamber, the improvement wherein said compensating means comprises a generally radially disposed and forwardly facing first annular seating surface on said gas cylinder, at least one gas vent port defined by said gas cylinder communicating with said gas chamber and opening through said first annular seating surface, a plurality of guide members mounted in fixed position on and projecting forwardly from said gas cylinder in axially parallel relation to the axis of said magazine tube, an obturation ring supported on said guide members in coaxial encircling relation to an associated portion of said magazine tube forward of said gas cylinder and having a generally radially disposed and rearwardly facing second annular seating surface for seating engagement with said first annular seating surface, a stabalizing ring coaxially encircling said magazine tube and received on forward end portions of said guide members, and a plurality of springs equal in number to said guide members, each of said springs received on an associated one of said guide members, said springs acting between said stabalizing ring and said obturation ring and biasing said obturation ring toward said gas cylinder to maintain second annular seating surface in seating engagement with said first annular seating surface and in closing relation to said one gas vent port when the pressure within said gas cylinder is lower than a predetermined magnitude, said obturation ring being movable away from said gas cylinder and out of seating engagement with said cylinder in response to pressure within said chamber in excess of said predetermined magnitude to vent gases of explosion from said gas chamber through said one gas port and to the atmosphere.

7. In a firearm as set forth in claim 6 the further improvement comprising a plurality of nuts equal in number to said rods, each of said nuts being threadably engaged with the forward end portion of an associated rod forward of said stabalizing ring.

8. In a firearm having a receiver, a barrel supported on and projecting forwardly of the receiver and including a bore, a breech bolt supported within the receiver for movement therein between battery and retired positions, a magazine tube supported on and projecting forwardly of the receiver in axially parallel relation to the barrel, a generally cylindrical gas cylinder mounted in fixed position relative to the barrel and coaxially surrounding an associated portion of the magazine tube in axially spaced relation to the receiver, an annular piston received within the gas cylinder and coaxially surrounding an associated portion of the magazine tube, the piston being supported on said magazine tube for movement therealong and generally toward and away from the receiver, action bar means for moving the breech bolt in response to movement of the piston relative to the gas cylinder, the cylinder cooperating with the magazine tube and the piston to define and annular gas chamber, means defining a bleed port communicating with the bore and with the gas chamber forward of the piston for venting gases of explosion from the bore into the gas chamber, and compensating means for limiting pressure developed within the gas chamber, the improvement wherein said compensating means comprises a generally radially disposed and forwardly facing first annular seating surface on said gas cylinder, at least one gas vent port defined by said gas cylinder communicating with said gas chamber and opening through said first annular seating surface, an obturation ring supported in coaxial encircling relation to an associated portion of said magazine tube forward of said gas cylinder and having a generally radially disposed and rearward facing second annular seating surface for seating engagement with said first annular seating surface, a plurality of guide members mounted in fixed position on and projecting forwardly from said gas cylinder in axially parallel relation to the axis of the magazine tube, and means for biasing said obturation ring toward said gas cylinder to maintain second annular seating surface in seating engagement with said first annular seating surface and in closing relation to said one gas vent port when the magnitude of pressure within said gas cylinder is lower than a predetermined magnitude and including a plurality of springs equal in number to said guide members, each of said springs received on an associated one of said guide members and acting upon said obturation ring, said obturation ring being movable away form said gas cylinder and out of seating engagement with said first annular seating surface in response to pressure within said chamber in excess of said predetermined magnitude to vent gases of explosion from said gas chamber through said one gas port and to the atmosphere.

9. In a firearm as set forth in claim 8 the further improvement wherein each of said guide members comprises a stud threadably engaged with said gas cylinder and a cap nut threadably engaged with the free end of said stud and said associated spring is disposed between said cap nut and said obturation ring.

10. In a firearm as set forth in claim 8 including the further improvement wherein said compensating means includes means for adjusting said predetermined pressure.

11. In a firearm as set forth in claim 10 the further improvement wherein said adjusting means comprises threaded fasteners.

* * * * *